US006535001B1

(12) United States Patent
Wang

(10) Patent No.: US 6,535,001 B1
(45) **Date of Patent: *Mar. 18, 2003**

(54) METHOD AND DEVICE FOR SENSING OIL CONDITION

(75) Inventor: Su-Chee Simon Wang, Troy, MI (US)

(73) Assignees: Delphi Technologies, Inc, Troy, MI (US); General Motors Corporation, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,532

(22) Filed: May 1, 2000

(51) Int. Cl.[7] ..... G01R 27/08; B60Q 1/00; F02N 17/00

(52) U.S. Cl. ..... 324/698; 340/450; 123/196 S; 123/196 R; 123/198 D; 123/179

(58) Field of Search ..... 324/698, 689, 324/679, 681, 685, 663; 73/53.05; 340/603, 604, 631, 630, 450.3; 124/556; 377/1–26

(56) References Cited

U.S. PATENT DOCUMENTS 4,007,629 A * 2/1977 Hochstein ..... 73/53.05
4,112,744 A * 9/1978 Tassano ..... 73/61.61
4,306,525 A * 12/1981 Faxvog ..... 123/196 S
4,410,885 A * 10/1983 Stenstrom ..... 340/604
4,506,337 A * 3/1985 Yasuhara ..... 701/30
4,544,880 A * 10/1985 Nagy et al. ..... 324/642
4,646,070 A * 2/1987 Yasuhara et al. ..... 340/603
4,686,857 A * 8/1987 Kato ..... 73/304 R
4,694,793 A * 9/1987 Kawakita et al. ..... 123/196 S
4,733,556 A * 3/1988 Meitzler et al. ..... 324/442
4,740,777 A * 4/1988 Slocum et al. ..... 340/522
4,764,258 A * 8/1988 Kauffman ..... 205/786
4,785,287 A * 11/1988 Honna et al. ..... 340/631
5,103,184 A * 4/1992 Kapsokavathis et al. ... 73/61.44
5,274,334 A * 12/1993 Wang et al. ..... 324/689
5,789,665 A * 8/1998 Voelker et al. ..... 73/53.05

* cited by examiner

*Primary Examiner*—N. Le
*Assistant Examiner*—Wasseem H. Hamdan
(74) *Attorney, Agent, or Firm*—Margaret A. Dobrowitsky

(57) ABSTRACT

A device for sensing oil condition includes an oil condition sensor that includes a first sensing plate separated from a second sensing plate by a spacer. Affixed to the first sensing plate and the second sensing plate is a platinum sensing electrode and a resistance temperature device. The sensing electrodes are separated by a gap that is filled with engine oil when the sensor is installed in an oil pan. A processor connected to the sensor can be used to determine when the engine is experiencing a first stage of oil degradation, a second stage of oil degradation, and a third stage of oil degradation. Each stage of degradation is characterized by a first sensor output signal trend, a second sensor output signal trend, and a third output signal trend, respectively.

2 Claims, 3 Drawing Sheets

*SENSOR OUTPUT AT 35, 50, & 80 C

METHOD AND DEVICE FOR SENSING OIL CONDITION

TECHNICAL FIELD

The present invention relates generally to motor vehicle oil sensors.

BACKGROUND OF THE INVENTION

In order to prolong the life of a combustion engine, the oil which provides lubrication to the vital components within the engine must be changed at regular intervals. Most oil changes today are conducted based on schedules recommended by manufacturers of the vehicles. Due to customer desire, the intervals between oil changes are getting longer. Longer intervals reduce pollution associated with the disposal of waste oil. Similarly, reducing unnecessary oil changes helps minimize pollution due to waste oil. Unfortunately, the useful life of oil varies greatly depending on the quality of the oil, the type of engine in which the oil is disposed, the ambient conditions, and the vehicle service schedule. Moreover, contamination of the oil by antifreeze or water can severely reduce the oil's lubrication and anti-wear functions.

As a result, the interval between oil changes may exceed the useful life of the oil and thus, it is necessary to monitor the condition of the oil between changes to ensure that the oil is still providing the necessary lubrication. If the condition of the oil has deteriorated or it is contaminated, it may be changed before the recommended time so that the engine will not be harmed.

Accordingly, electrochemical oil condition sensors have been provided that sense the condition of the oil and generate warning signals when maintenance, i.e., an oil change, is due as indicated by the condition of the oil. One such sensor is disclosed by U.S. Pat. No. 5,274,335 (the "'335 patent"). The '335 patent discloses a sensor composed of two gold plated iron electrodes that are separated by a gap in which test oil is disposed. A triangular waveform is applied between the electrodes and the current induced by the externally applied potential is used as a parameter to determine the condition of the oil within the sensor.

The above-mentioned sensor, like others, however, cannot detect when the wrong oil is used to fill the oil pan or used to top off the oil pan. Moreover, these sensors cannot detect a large coolant or water leak into the oil pan, nor can they detect when the oil has been changed.

The present invention has recognized these prior art drawbacks, and has provided the below-disclosed solutions to one or more of the prior art deficiencies.

SUMMARY OF THE INVENTION

A processor for generating a signal representative of engine oil condition includes means for receiving input from at least one oil condition sensor sensing oil condition in an engine. The processor further includes means for determining that the engine is experiencing a first stage of oil degradation based on the input. The first stage of oil degradation is characterized by a first sensor output signal trend based. The processor includes means for determining that the engine is experiencing a second stage of oil degradation based on the input. The second stage of oil degradation is characterized by a second sensor output signal trend that is different from the first sensor output signal trend. Moreover, the processor includes means for determining that the engine is experiencing a third stage of oil degradation based on the input. The third stage of oil degradation is characterized by a third sensor output signal trend that is different from the first sensor output signal trend and second sensor output signal trend. The processor also includes means responsive to the means for determining for generating a signal representative of: an approach of an end of the first stage of oil degradation, an entry into the second stage of oil degradation, and an entry into the third stage of oil degradation.

In a preferred embodiment, the processor includes means for maintaining a count that represents how many consecutive times an engine has been started and then stopped without the oil temperature reaching a threshold temperature. Preferably, the processor also includes means for generating a signal based on the count. The signal based on the count is useful for indicating oil condition.

The present invention will now be described, by way of example, with reference to the accompanying drawings, in which:

DESCRIPTION OF AN EMBODIMENT OF THE INVENTION

Figure 1:
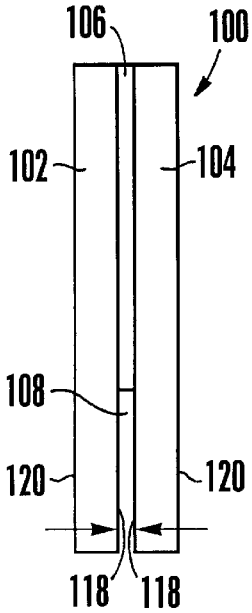
FIG. 1 is a side plan view of the sensor.

Referring initially to FIG. 1, an oil condition sensor is shown and generally designated 100. FIG. 1 shows that the oil condition sensor 100 includes a preferably flat, first sensing plate 102 slightly separated from a preferably flat, second sensing plate 104 by a spacer 106. In a preferred embodiment, both sensing plates 102, 104 are manufactured from alumina. As seen in FIG. 1, the spacer 106 is smaller than the sensing plates 102, 104 such that a gap 108 is established between the plates 102, 104. Preferably, the gap 108 is approximately one millimeter (1 mm) wide and when the sensor 100 is installed in an oil pan (not shown) the gap 108 is filled with motor oil.

Figure 2:
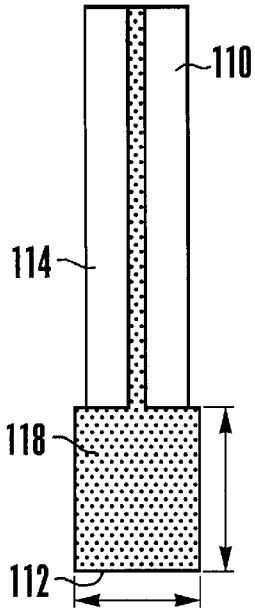
FIG. 2 is a front plan view of a sensing plate.
Figure 3:
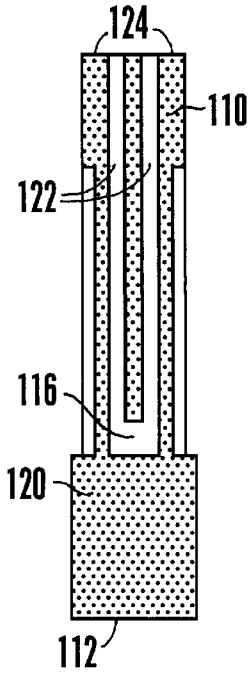
FIG. 3 is a rear plan view of a sensing plate.

Referring now to FIGS. 2 and 3, detail concerning the first sensing plate 102 is shown. FIGS. 2 and 3 show that the sensing plate 102 includes a proximal end 110, a distal end 112, a front surface 114 and a back surface 116. Referring specifically to FIG. 2, a preferably platinum sensing electrode 118 is attached to the distal end 112 of the front surface 114 of the sensing plate 102. It is to be appreciated that the sensing electrode 118 can be made of any conductive material that is stable in engine oil, e.g., nickel, stainless steel, or brass. In a preferred embodiment, the sensing electrode 118 is eleven millimeters (11 mm) wide and twenty millimeters (20 mm) long. FIG. 3 shows a resistance temperature device (RTD) 120 attached to the distal end 112 of the back surface 116 of the sensing plate 102. In a preferred embodiment, the RTD 120 has a resistance of approximately one hundred ohms (100 W). Preferably, the sensing electrode 118 and the RTD 120 are screen printed on the sensing plate 102. FIG. 3 also shows one or more, preferably two, sensing electrode bonding pads 122 attached to the back surface 116 of the sensing plate 102. Moreover, one or more, preferably two, RTD bonding pads 124 are also attached to the back surface 116 of the sensing plate 102.

It is to be understood that the sensing plates 102, 104 are identical to each other. Referring back to FIG. 1, it is shown that the sensing plates 102, 104 are placed so that the front surface 114 of the first plate 102 is facing the front surface 114 of the second plate 104, i.e., the sensing electrodes 118 are facing each other across the gap 108 and the RTDs 120 are facing outwardly from the sensor 100. It is also to be understood that the platinum sensing electrodes 118 are used to monitor the oil condition, while the RTD resistors 120 are used to measure the oil temperature and also to heat the sensor 100 for the newly incorporated oil level sensing capability. During operation of the sensor 100, a signal may be provided across the sensing plates 102, 104. By measuring the output voltage of the sensor 100 at different temperatures, the condition of the oil may be determined as described below.

Figure 4:
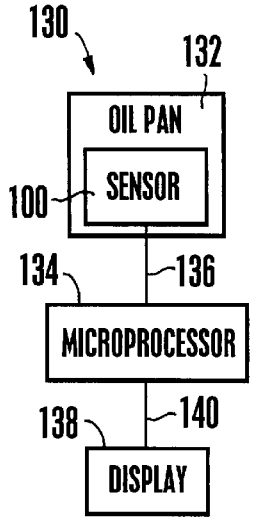
FIG. 4 is a block diagram representing a vehicle system in which the oil condition sensor is installed.

Referring now to FIG. 4, a vehicle system in which the sensor 100. is installed is shown and generally designated 130. FIG. 4 shows the sensor 100 installed in an oil pan 132 such that the sensor is at least partially submerged in engine oil. In turn, the sensor 100 is electrically connected to a digital processing apparatus, e.g., a microprocessor 134 by electrical line 136. The microprocessor 134 is connected to a display, e.g., a warning lamp 138 by electrical line 140 and a signal may be provided to illuminate the warning lamp 138 when the condition of the oil degrades below a predetermined critical level or when the oil becomes severely contaminated by engine coolant, such as anti-freeze or water.

Figure 5:
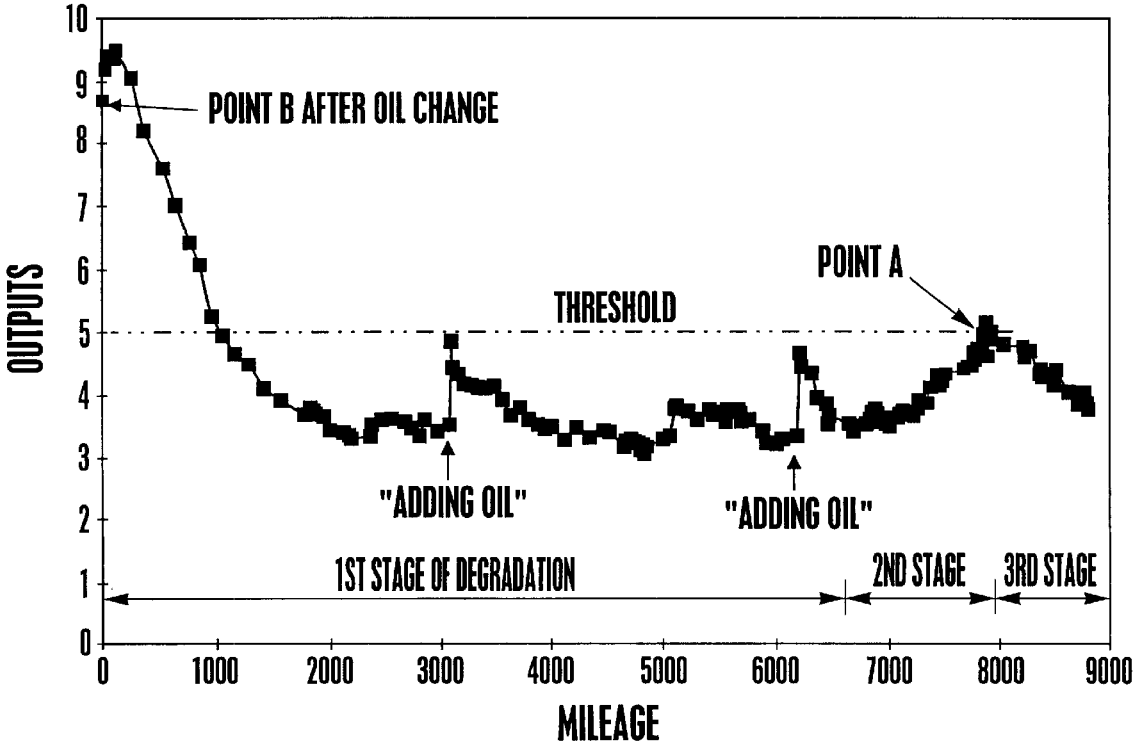
FIG. 5 is a graph showing the output of the sensor when installed in a Chevrolet Blazer.

FIG. 5 shows a graph of the sensor output with the sensor 100 installed in a Chevrolet Blazer with Mobil SH, SAE 5W-30 engine oil used as the lubricant in the oil pan. FIG. 5 shows that the output of the sensor 100 declined abruptly and then leveled after 2,000 miles of driving. As understood herein, the decrease of the sensor output is due to the consumption/transformation of oil additives, e.g., detergents blended in fresh engine oil. This stage is designated as the first stage of oil degradation. FIG. 5 shows that the sensor outputs increased in the Blazer after 6,700 miles of driving. The outputs then peaked at 8,000 miles and then started declining. Accordingly, the second stage of oil degradation occurred in the Blazer between 6,700 miles of driving and 8,000 miles of driving. The third stage of oil degradation occurred after 8,000 miles. As recognized by the present invention, the increase of the sensor outputs between 6,700 miles of driving and 8,000 miles of driving in the Blazer are associated with the increase of acidic oxidation products or the total acid number (TAN) in the engine oil. The varying sensor outputs can be used, as described below, to warn the driver of the vehicle when an oil change is pending or absolutely required.

While the preferred implementation of the microprocessor 134 is an onboard chip such as a digital signal processor, it is to be understood that the logic disclosed below can be executed by other digital processors, such as by a personal computer made by International Business Machines Corporation (IBM) of Armonk, N.Y. Or, the microprocessor 134 may be any computer, including a Unix computer, or OS/2 server, or Windows NT server, or an IBM laptop computer.

The microprocessor 134 includes a series of computer-executable instructions, as described below, which will allow the microprocessor 134 through information provided to it by the sensor 100 to determine whether the engine oil has degraded or has been contaminated by water or anti-freeze. These instructions may reside, for example, in RAM of the microprocessor 134.

Alternatively, the instructions may be contained on a data storage device with a computer readable medium, such as a computer diskette. Or, the instructions may be stored on a DASD array, magnetic tape, conventional hard disk drive, electronic read-only memory, optical storage device, or other appropriate data storage device. In an illustrative embodiment of the invention, the computer-executable instructions may be lines-of compiled C++ compatible code.

The flow charts herein illustrate the structure of the logic of the present invention as embodied in computer program software. Those skilled in the art will appreciate that the flow charts illustrate the structures of computer program code elements including logic circuits on an integrated circuit, that function according to this invention. Manifestly, the invention is practiced in its essential embodiment by a machine component that renders the program elements in a form that instructs a digital processing apparatus (that is, a computer) to perform a sequence of function steps corresponding to those shown.

Figure 6:
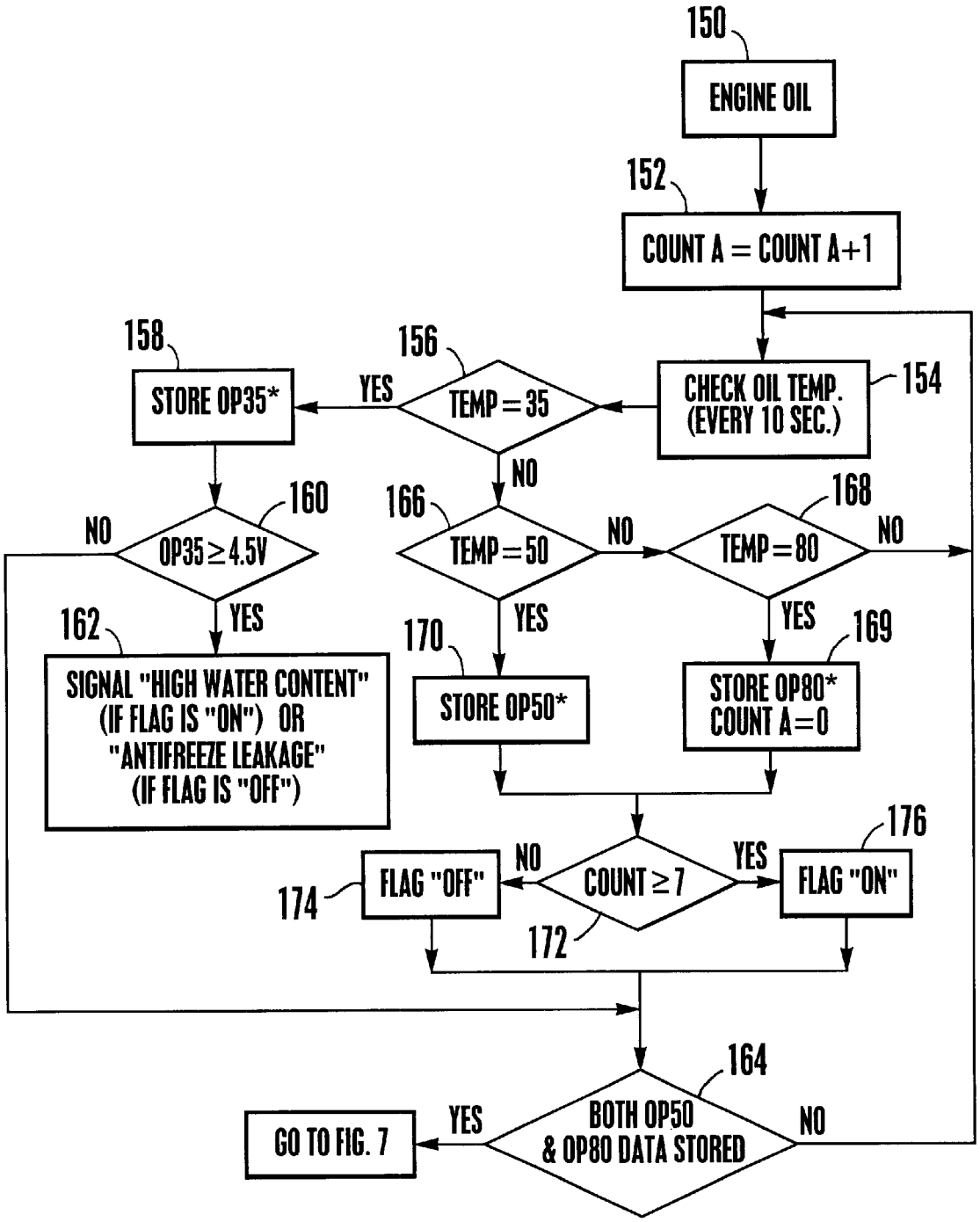
FIG. 6 is a flow chart representing a series of method steps that are used to determine whether engine oil is contaminated by water or anti-freeze.

Now referring to FIG. 6, the logic used by the present invention to determine whether engine oil in which the sensor 100 is disposed is contaminated, e.g., by water or anti-freeze is shown. Commencing at block 150 the engine is turned on. Moving to block 152 a first counter, "Count A," is incremented by one (1), and then at block 154 the temperature of the engine oil is checked every ten seconds. Proceeding to decision diamond 156 it is determined whether the temperature of the engine oil is equal to thirty-five degrees Celsius (35° C.). When the temperature is equal to thirty-five degrees Celsius (35° C.), the logic moves from decision diamond 156 to block 158, wherein the sensor output at thirty-five degrees Celsius (35° C.) is stored in the microprocessor 134, e.g., in RAM.

Next, at decision diamond 160 the output is compared to a threshold value, e.g., four and one-half volts (4.5 V). If the sensor output is greater than four and one-half volts (4.5 V) the logic moves to block 162. If, at block 162, the flag described below is turned on, then a warning lamp signaling "High Water Content" is illuminated. Thus, the driver will know that he or she must drive the vehicle for an extended period of time in order to heat the oil and evaporate the water in the oil pan. If the flag is turned off, then a warning lamp signaling "Antifreeze Leakage" is illuminated. Accordingly, the driver should have the vehicle serviced to determine the cause of the anti-freeze leak into the oil pan.

As shown in FIG. 6, if the sensor output at decision diamond 160 is less than four and one-half volts (4.5 V), then the logic moves to decision block 164 where it is determined whether the sensor output at both fifty degrees Celsius (50° C.) and eighty degrees Celsius (80° C.) has been stored. If the sensor output at both of these temperatures has indeed been stored the logic moves to FIG. 7. If, however, the sensor output at these temperatures has not been stored the logic returns to block 154 where the oil temperature is again checked every ten seconds. The logic then moves again to decision diamond 156 to determine whether the temperature is equal to thirty-five degrees Celsius (35° C.). If the temperature is equal to thirty-five degrees Celsius, the logic proceeds as described above. If the temperature is not equal to thirty-five degrees Celsius (35°), then the logic proceeds to decision diamond 166 where it is determined whether the temperature is equal to fifty degrees Celsius (50° C.). If not, the logic continues to decision diamond 168 where it is determined whether the temperature is equal to eighty degrees Celsius (80° C.). If the temperature is not equal to eighty degrees Celsius (80° C.), the logic returns to block 154 to again check the oil temperature and continue to decision block 156.

If at decision block 166 the oil temperature is equal to fifty degrees Celsius (50° C.), then the logic moves to block 170 and the sensor output at fifty degrees Celsius (50° C.) is stored by the microprocessor 134. Then the logic proceeds to decision diamond 172 where Count A is compared to a predetermined threshold, e.g., seven (7). If Count A is less than seven (7), then at block 174 a Flag is turned "off." On the other hand, if Count A is greater than seven (7), the Flag is turned "on" at block 176. From block 174 and 176 the logic moves to decision diamond 164 to again determine whether a sensor output at both fifty degrees Celsius and eighty degrees Celsius (50° C. and 80° C.) has been stored. If so, the logic proceeds to that shown in FIG. 6. If not, the logic returns to block 154 to again check the oil temperature.

The logic proceeds as described above until the temperature at decision block 168 is equal to eighty degrees Celsius (80° C.). When the temperature at decision block 168 equals eighty degrees Celsius (80° C.), the logic continues to block 169, wherein the microprocessor stores the sensor output at eighty degrees Celsius (80° C.) and resets Count A to zero. Proceeding to decision diamond 172, since Count A is less than seven (7), the Flag is turned "off" at block 174 and the logic moves to decision diamond 164. At decision diamond 164, it is again determined whether the sensor output for fifty degrees Celsius and eighty degrees Celsius (50° C. and 80° C.) has been stored, and if so, the logic proceeds to FIG. 7 to determine the condition of the oil at operating temperature, i.e., eighty degrees Celsius (80° C.) and above.

Figure 7:
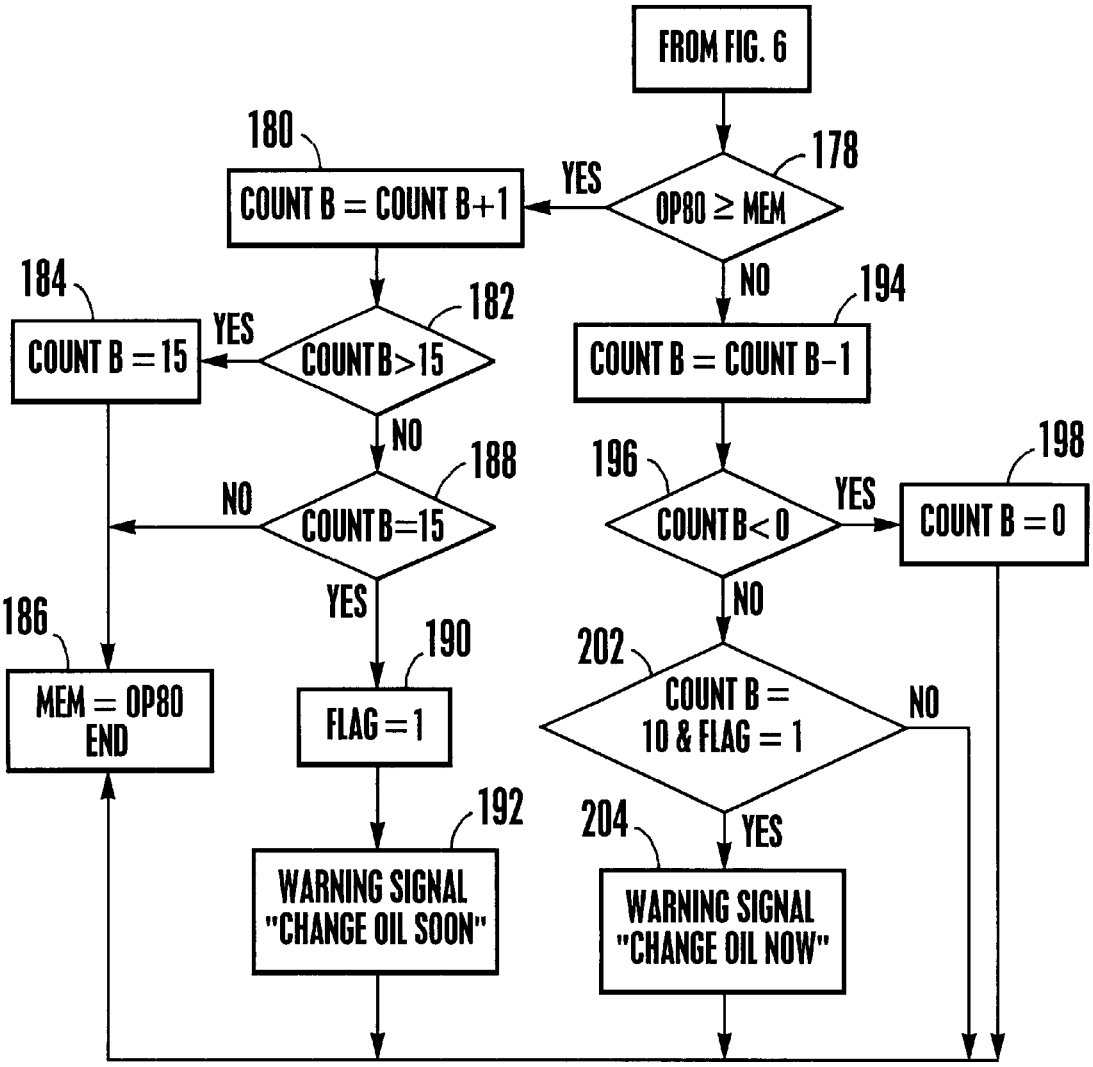
FIG. 7 is a flow chart representing a series of method steps that are used to determine the condition of uncontaminated oil.

From FIG. 6, the logic continues to decision diamond 178 shown in FIG. 7. At decision diamond 178, the present sensor output at eighty degrees Celsius (80° C.) is compared to the previous sensor output stored in memory. If the present sensor output is greater than the previous sensor output, the logic moves to block 180 where a second counter, "Count B," is increased by one (1). Next, at decision diamond 182, Count B is compared to a threshold value, e.g., fifteen (15). If Count B is greater than fifteen (15), then the logic moves to block 184 where Count B is set to equal fifteen (15). The logic then moves to block 186 where the present sensor output at eighty degrees Celsius (80° C.) is stored in memory to be used as the comparison value at decision diamond 178 when the microprocessor proceeds through the logic flow again, e.g., after the vehicle is turned off and then restarted.

If, at decision diamond 182, it is determined that Count B is not greater than fifteen (15), the logic moves to decision diamond 188 to determine whether Count B is equal to fifteen (15). If Count B value is not equal to fifteen (15), then the logic proceeds to block 186 where the present sensor output is stored in memory. If Count B is equal to fifteen (15), then a Flag value is set equal to one (1) at block 190 and the logic proceeds to block 192 where a signal is illuminated warning the driver to "Change Oil Soon."

If the present sensor output is less than the previous sensor output, the logic moves from decision diamond 178 to block 194 where Count B is decreased by one (1) from the present value of Count B. Next, at decision diamond 196 it is determined whether Count B value is less than zero (0). If Count B is indeed less than zero (0), then Count B is set to zero at block 198 and the logic moves to block 186 where the present sensor output at eighty degrees Celsius (80° C.) is stored in the memory as the value to be compared to at decision diamond 178 described above and the logic ends until the car is started again.

If Count B at decision diamond 196 is greater than zero, the logic continues to decision diamond 202 where it is determined whether Count B is equal to a predetermined threshold value, e.g., ten (10) and whether the Flag value is equal to one (1). If these comparisons hold true, then a signal is illuminated at block 204 warning the driver to "Change Oil Now" and the logic moves to block 186 where the present sensor output at eighty degrees Celsius (80° C.) is stored in memory. If on the other hand, Count B is not equal to ten (10) or the Flag is not equal to one (1), a warning signal is not illuminated and the present sensor output at eighty degrees Celsius (80° C.) is stored as the memory value.

It is to be understood that Count A, defined in FIG. 6, keeps track of how many times the engine has been started without the oil temperature exceeding eighty degrees Celsius (80° C.). The more times the engine has been started without the oil temperature exceeding eighty degrees Celsius (80° C.) the more likely it is that the contamination in the oil is plain water. However, if the oil temperature regularly exceeds eighty degrees Celsius (80° C.) the water contamination will have evaporated and any contamination in the oil is more likely to be anti-freeze. Additionally, it is to be understood that Count B, defined in FIG. 7, is used to determine when the condition of the oil enters the second stage of oil degradation and reaches the third stage of oil degradation.

More specifically, as the output of the sensor approaches the end of the second stage of oil degradation, indicated by Point "A" in FIG. 5, and continuously increases, Count B is increased incrementally each time the present sensor output is greater than the previously stored sensor output. After a predetermined number of times, e.g. fifteen (15), that the present sensor output is greater than the previous sensor output, the driver is warned to "Change Oil Soon." When the output of the sensor approaches the end of the third stage of oil degradation, the sensor output decreases as shown in FIG. 5 and Count B is decreased incrementally each time the present sensor output is less than the previously stored sensor output. After a predetermined number of times, e.g., five (5), that the present sensor output is less than the previous output, the driver is warned to "Change Oil Now."

It is to be understood that the first up-trend of the sensor outputs indicates the onset of the second stage of oil degradation and the first downtrend after the second stage of degradation indicates the onset of the third stage of oil degradation. The algorithm represented by FIG. 7 is one of many methods that can be employed to detect these upward and downward trends of the sensor output. An alternative method is to measure the slope change of consecutive sensor outputs stored in a memory chip.

With the configuration of structure and logic described above, it is to be appreciated that the Method And Device For Sensing Oil Condition can be used to relatively accurately and relatively inexpensively determine when it may be necessary to change the oil in a motor vehicle based on the actual condition of the oil in the oil pan.

While the particular Method And Device For Sensing Oil Condition as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A processor for generating a signal representative of engine oil condition, comprising:

means for receiving input from at least one oil condition sensor sensing oil condition in an engine;

means for, based on the input, determining that the engine is experiencing a first stage of oil degradation characterized by a first sensor output signal trend;

means for, based on the input, determining that the engine is experiencing a second stage of oil degradation characterized by a second sensor output signal trend different from the first sensor output signal trend;

means for, based on the input, determining that the engine is experiencing a third stage of oil degradation characterized by a third sensor output signal trend different from the first sensor output signal trend and second sensor output signal trend; and means responsive to the means for determining for generating a signal representative of at least one of: an approach of an end of the first stage of oil degradation, an entry into the second stage of oil degradation, and an entry into the third stage of oil degradation.

2. The processor of claim 1, comprising:

means for maintaining a count representing how many consecutive times an engine has been started and then stopped without oil temperature reaching a threshold temperature; and means for generating a signal based on the count, the signal based on the cold operation count being useful for indicating oil condition.

* * * * *